US007610934B2

(12) United States Patent
Naciri et al.

(10) Patent No.: US 7,610,934 B2
(45) Date of Patent: Nov. 3, 2009

(54) HYDROCARBON TRANSFER SYSTEM WITH A DAMPED TRANSFER ARM

(75) Inventors: Mamoun Naciri, Vallauris (FR); Jean-Pierre Queau, Nice (FR)

(73) Assignee: Single Buoy Moorings Inc., Marly (CH)

( * ) Notice: Subject to any disclaimer, the term of this patent is extended or adjusted under 35 U.S.C. 154(b) by 238 days.

(21) Appl. No.: 10/555,791

(22) PCT Filed: May 4, 2004

(86) PCT No.: PCT/EP2004/004893

§ 371 (c)(1),
(2), (4) Date: Nov. 7, 2005

(87) PCT Pub. No.: WO2004/099061

PCT Pub. Date: Nov. 18, 2004

(65) Prior Publication Data

US 2006/0233629 A1 Oct. 19, 2006

(30) Foreign Application Priority Data

May 5, 2003 (EP) ..... 03076303

(51) Int. Cl.
*F15B 9/00* (2006.01)

(52) U.S. Cl. ..... 137/615; 141/387; 414/138.2

(58) Field of Classification Search ..... 137/615; 141/387; 193/17–21, 24; 251/64; 212/308; 414/137.9, 138.1, 138.2
See application file for complete search history.

(56) References Cited

U.S. PATENT DOCUMENTS 2,739,778 A * 3/1956 Krone et al. ..... 137/615
3,086,552 A * 4/1963 Ragsdale ..... 137/615
3,217,748 A * 11/1965 Harper ..... 137/615
3,455,333 A 7/1969 Bily
3,458,167 A 7/1969 Cooley
3,891,004 A * 6/1975 Knight ..... 137/615

(Continued)

FOREIGN PATENT DOCUMENTS

DE 25 26 330 12/1976

(Continued)

OTHER PUBLICATIONS

IHC|CALAND Annual Report 2002, Cover page.*

*Primary Examiner*—John Rivell
*Assistant Examiner*—Craig Price
(74) *Attorney, Agent, or Firm*—Young & Thompson

(57) ABSTRACT

Hydrocarbon transfer system includes a first structure having a substantially vertical first arm hingingly connected to the first structure via a first articulation around a substantially horizontal axis and a second arm attached to the first arm in an articulation joint, the second arm having a connecting arm part carrying a releasable connector for connecting to a floating second structure and a restoring arm part carrying a counterweight for exerting a restoring force on the second structure that is connected to the second arm upon relative movement of the first and second structures, characterized in that damping elements are provided above water level, acting on the second arm for damping movement of the second arm around the articulation joint upon transition of the second arm from an operative position to an inoperative position after disconnecting the releasable connector from the second structure.

3 Claims, 19 Drawing Sheets

U.S. PATENT DOCUMENTS 4,190,080 A * 2/1980 Le Devehat ..... 137/615
4,261,398 A * 4/1981 Haley ..... 141/387
4,290,463 A * 9/1981 DeGeorge et al. ..... 141/387
4,653,554 A * 3/1987 Von Meyerinck et al. ... 141/387
4,844,133 A * 7/1989 von Meyerinck et al. .... 141/387
6,343,620 B1 * 2/2002 LeDevehat et al. ..... 137/615

FOREIGN PATENT DOCUMENTS

EP 1 283 159 2/2003

* cited by examiner

HYDROCARBON TRANSFER SYSTEM WITH A DAMPED TRANSFER ARM

The invention relates to a hydrocarbon transfer system comprising a first structure having a substantially vertical first arm hingingly connected to the first structure via a first articulation around a substantially horizontal axis and a second arm attached to the first arm in an articulation joint, the second arm having a connecting arm part carrying a releasable connector for connecting to a floating second structure and a restoring arm part carrying a counterweight for exerting a restoring force on the second structure that is connected to the second arm upon relative movement of the first and second structures.

Such a transfer system is known from European patent application nr. 01202973.2 and from WO 03/013951, in the name of the applicant. Upon disconnecting the connector from the tanker vessel, the horizontal arm will swing to a retracted position in which the horizontal arm extends at an angle of between 20 and 50 degrees relative to the horizontal, typically between 30 and 35 degrees. Upon disconnecting, the horizontal arm and counterweight will oscillate around their equilibrium position with a maximum angle of about twice the equilibrium angle. The swinging motion may be damped by suspending the counterweight from a cable below water level.

From U.S. Pat. No. 4,917,038 in the name of the applicant, a mooring system with quick-disconnect couplings is known wherein a submerged counterweight provides a damped restoring moment on a tanker while it is moored to the loading/offloading tower. After disconnecting the tanker from the tower, the horizontal mooring arm will be located on the water surface or below water level.

From U.S. Pat. No. 4,516,942 a single point mooring construction is known, comprising an A-frame suspended from cables at the bow of the tanker, the A-frame being at its end near the vessel provided with a restoring counterweight providing a restoring force on the vessel in the moored configuration.

U.S. Pat. No. 6,439,147 discloses a mooring system with passive or active force restoring members, operative in the moored configuration.

From DE-A-25 26 330 a hydrocarbon transfer system is known for unloading a tanker with an onshore mooring arm which is supported on a vertical column on the key side. The arm is provided with a counterweight and a damping mechanism with a pulley system coupled to a hydraulic cylinder and spring for controlled upward motion of the loading arm upon decoupling. The known counterweight is relatively small and is not laid out to provide a restoring force on the vessel connected to the arm during offloading. The external pulley system with its moving parts is relatively delicate and not suitable for reliable operation under offshore conditions, in particular when transferring cryogenic hydrocarbons, such as LNG.

It is an object of the present invention to provide a hydrocarbon transfer system which is of relatively simple design, and which can be rapidly connected and disconnected.

It is another object of the present invention to provide a hydrocarbon transfer system which after disconnecting is moved safely and reliably to a retracted position, without interfering with the moored vessel or with the supporting structure from which the arm is suspended.

It is again another object of the present invention to provide a hydrocarbon transfer system which can be easily inspected and maintained and which can reliably operate under harsh offshore conditions.

It is a further objective of the present invention to provide a mooring system for mooring two offshore structures, the mooring system being provided with a hydrocarbon transfer system, and a counterweight which provides a restoring force towards an equilibrium position upon relative movement of the two floating structures and which moves to a retracted position after disconnection in a controlled manner.

Hereto the transfer system according to the present invention is characterised in that damping means are provided above water level, acting on the second arm for damping movement of the second arm around the articulation joint upon transition of the second arm from an operative position to an inoperative position after disconnecting the releasable connector from the second structure.

Upon disconnecting, the horizontal arm will in view of the large mass of the restoring counterweight, swing upwards and may oscillate with a maximum amplitude of about twice the equilibrium angle. By providing damping means above water level, the horizontal arm can after disconnecting swing rapidly from its operative position—for instance substantially horizontal—to its equilibrium, or inoperative position, at a pitch of for instance 30-35 degrees, without oscillating back and interfering with the bow of the moored vessel or with its support structure. Hereby rapid and safe disconnecting is possible and damage to the connectors on the vessel and/or on the arm and to the hydrocarbon transfer ducts in or on the arms is avoided. Easy inspection of the damping means is possible in view of their position above water level.

The first structure may be a floating structure, such as a FLNG (Floating Liquefied Natural Gas) unit or a FSRU (Floating Storage and Regasification Unit) or a tower structure resting on the sea bed, such as an Import/export terminal, whereas the second structure may be a tanker (LNG).

In one embodiment, the damping means comprises a movable mass, movable relative to the second arm, in the direction of said arm. A fluid, such as oil, water, or a fluid-like material such a slurry or sand, or combinations thereof, may be included inside the second arm, in a part of the A-frame of which the second arm form a part. This provides a low-cost and easy maintenance damping system which allows the mass of the counter weight to be reduced. The amount of fluid in the system, the use of adjustable flow restrictions (baffles or valves) and the liquid distribution in the channels allows a wide range of pitching control of the transfer system.

In an alternative embodiment, the channel comprises a first channel part, mechanically attached to, and movable with the second arm and two transverse, second channel parts, in fluid communication with the first channel part. By providing a damping U-tube attached to the frame, a simple damping system, with no moving parts and low maintenance costs is achieved, allowing a large window of control. Instead of a separate U-tube configuration attached to the first and second arms, the second arm itself can be configured to have a generalised V-shape, one leg being situated on either side of the articulation joint, the damping liquid being movable in the second arm on each side of the articulation joint.

Instead of a fluid mass, or a slurry of sand or gravel in water, a solid mass may be used in the channel to provide a damping force. The solid mass may be placed in a liquid or may be provided with sliding members or lubrication to move in the channel.

In again another embodiment, the damping means comprise a damping member acting on or near the articulation joint increasing the moment required for rotation of the second arm in the articulation joint.

The damping member may comprise a damping cylinder connected with one end to the first arm and with a second end to the second arm. The damping cylinder may be hydraulic or pneumatic or a combination thereof, and provides a proven and robust damping system.

Alternatively, the articulation joint comprises a pin on one of the first or second arms and a rotating eye (167), rotatable around said pin on the other of the of the first or second arms, the damping member comprising a circumferential spring on the articulation joint attached with one end to the pin and with an other end the eye. Upon downward movement from its equilibrium position, the spring is tightened and stops the oscillatory movement. The springs add no extra mass to the mooring system and can be easily installed in the known articulation joints.

Again an alternative damping system may be obtained by providing an articulation joint which comprises a pin on one of the first or second arms and a rotating eye, rotatable around said pin on the other of the of the first or second arms, the damping member comprising a projection on the pin, engaging with a complementary projection on the eye upon movement of the second arm to the retracted position, the projections not engaging upon relative movement of the first and second arms in the operative position.

A number of embodiments of a transfer system according to the present invention will be described in detail with reference to the accompanying drawings. In the drawings.

Figure 13:
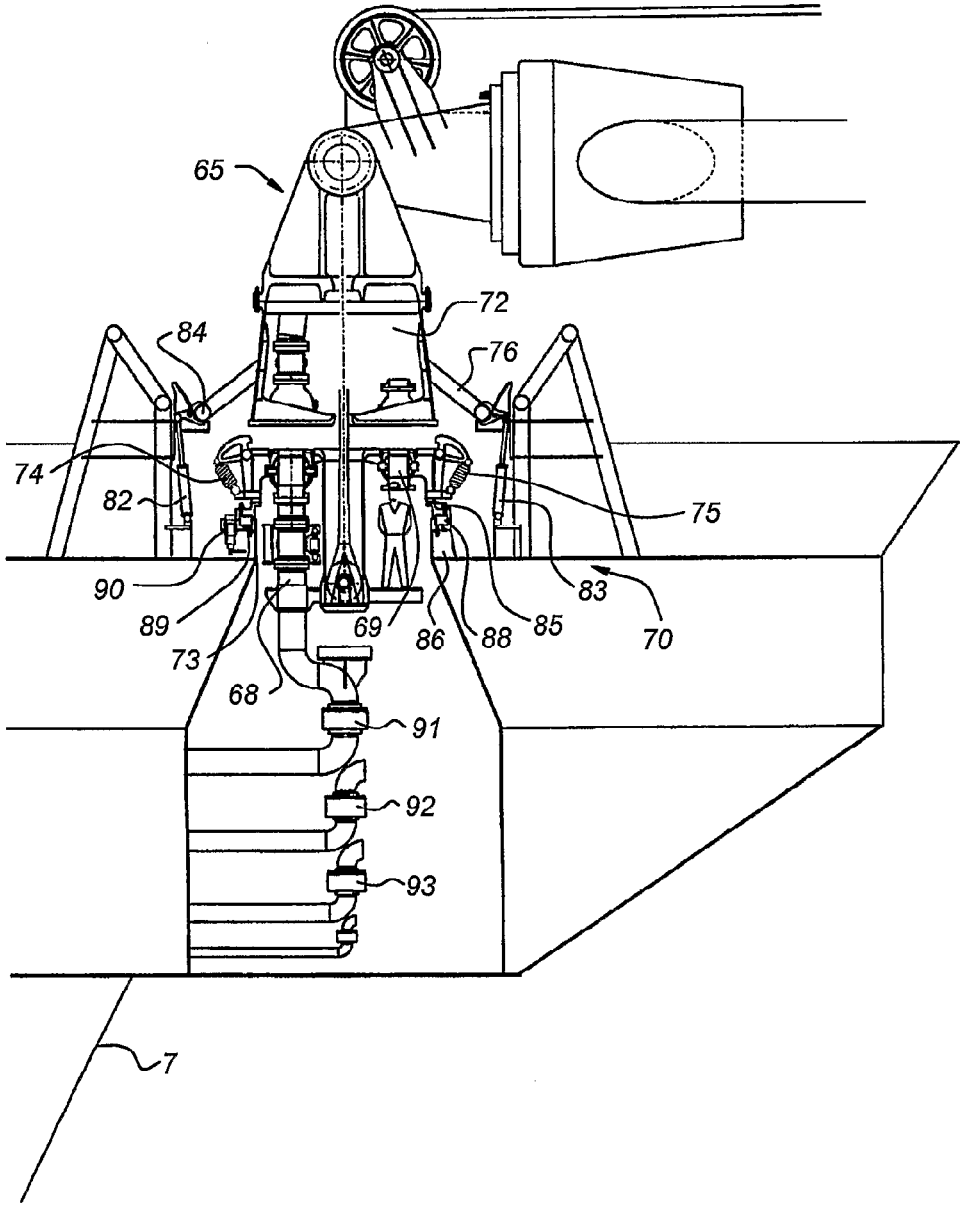
Figure 14:
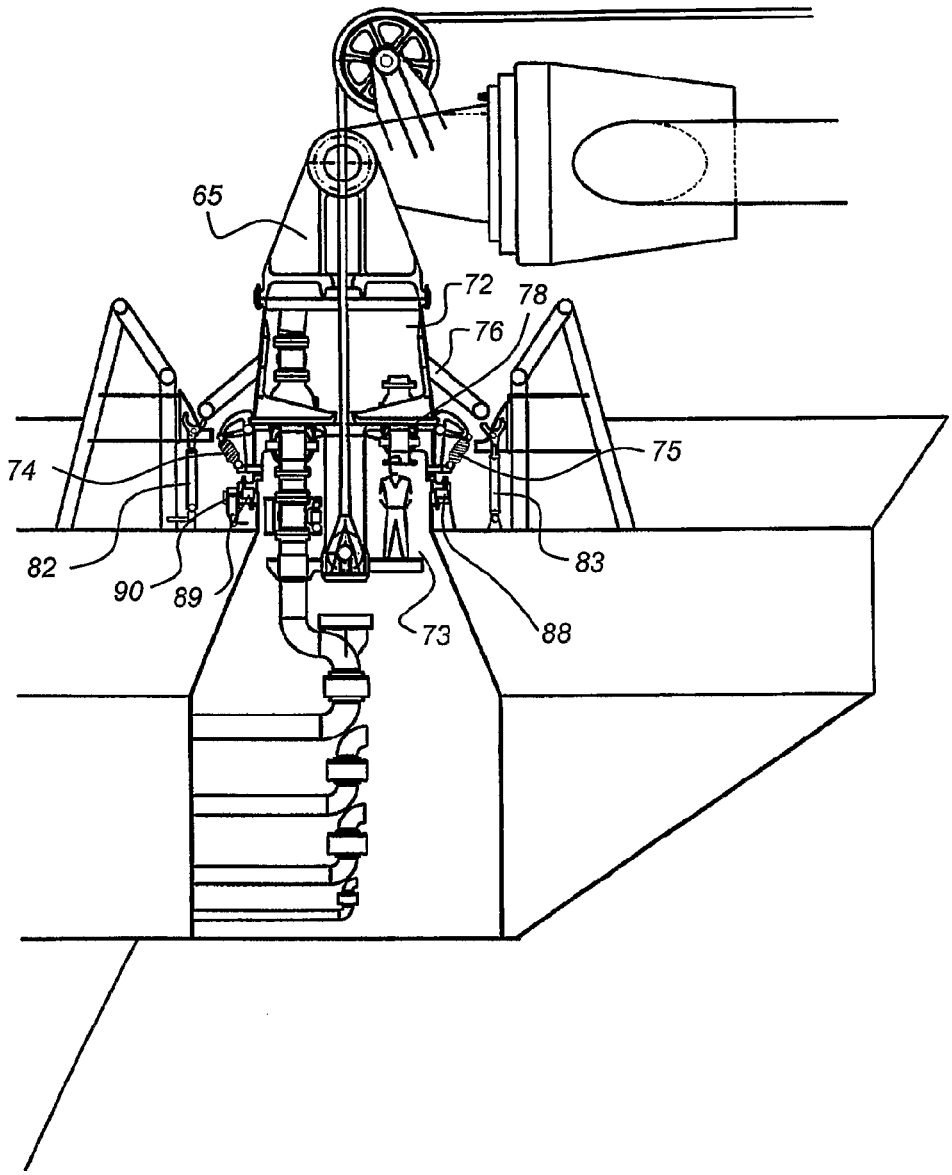
Figure 15:
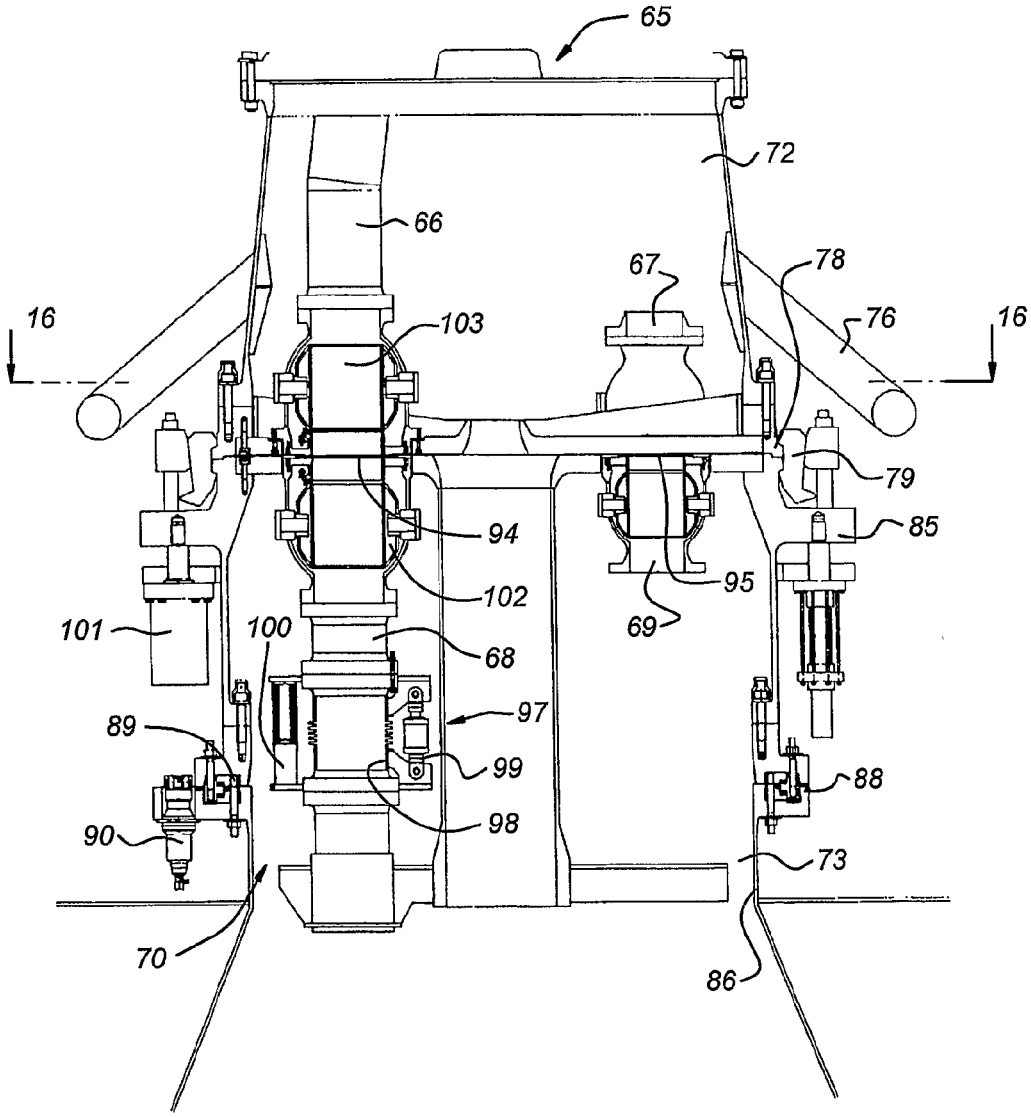
Figure 16:
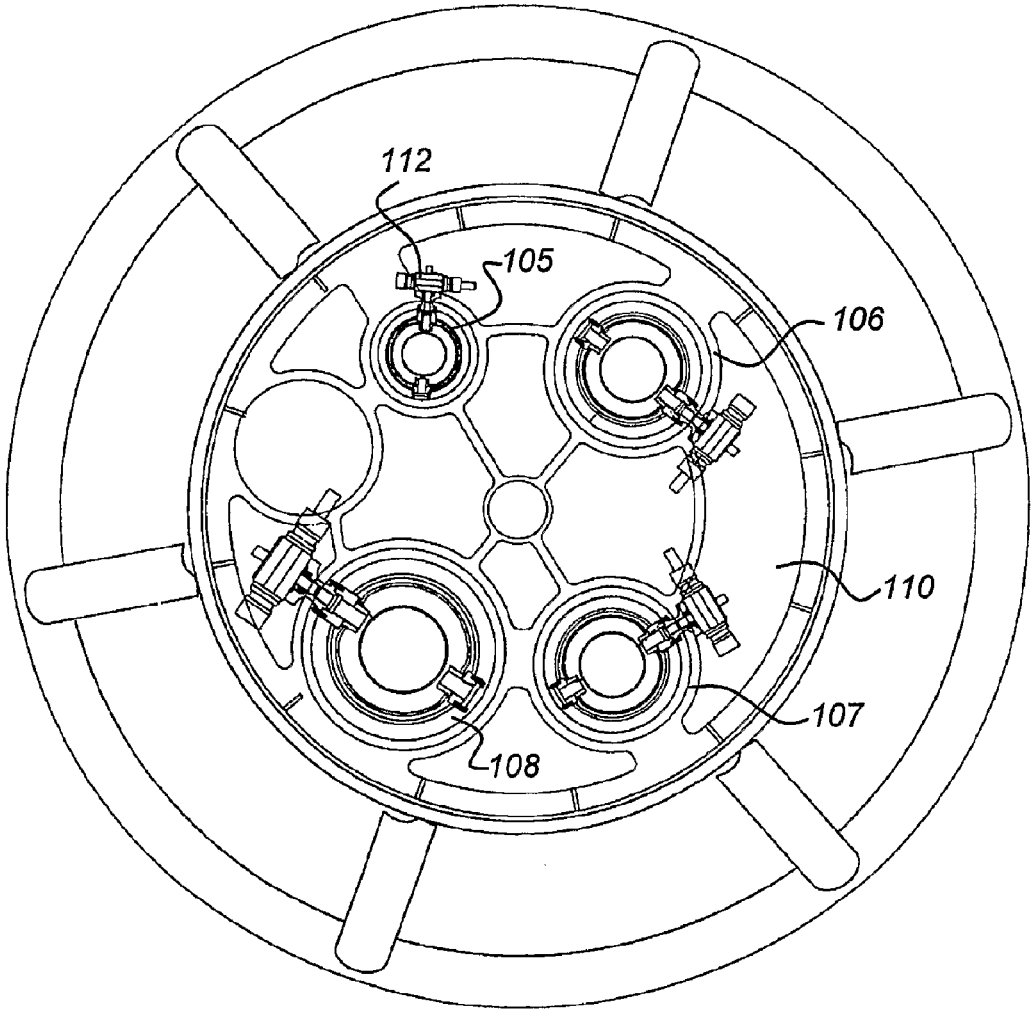

FIG. 13. shows the connector parts being aligned by the retractable grippers;

FIG. 14 shows the connector parts, aligned one above the other and interconnected through clamping means;

FIG. 15. shows a detail of the interconnected connector parts and fluid ducts;

FIG. 16 shows a cross-section along the line 16-16 in FIG. 15; and

Figure 17:
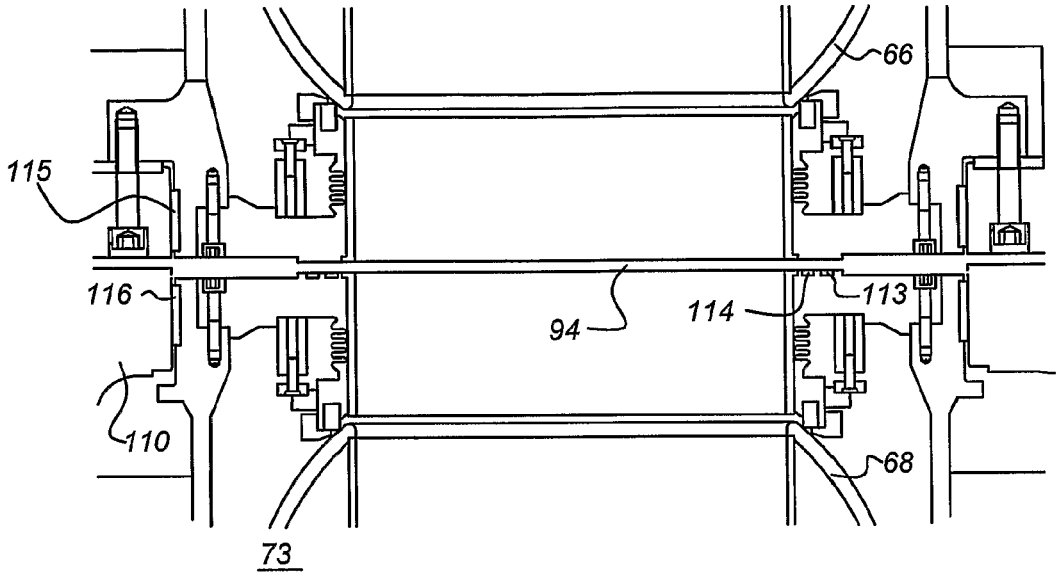
Figure 18:
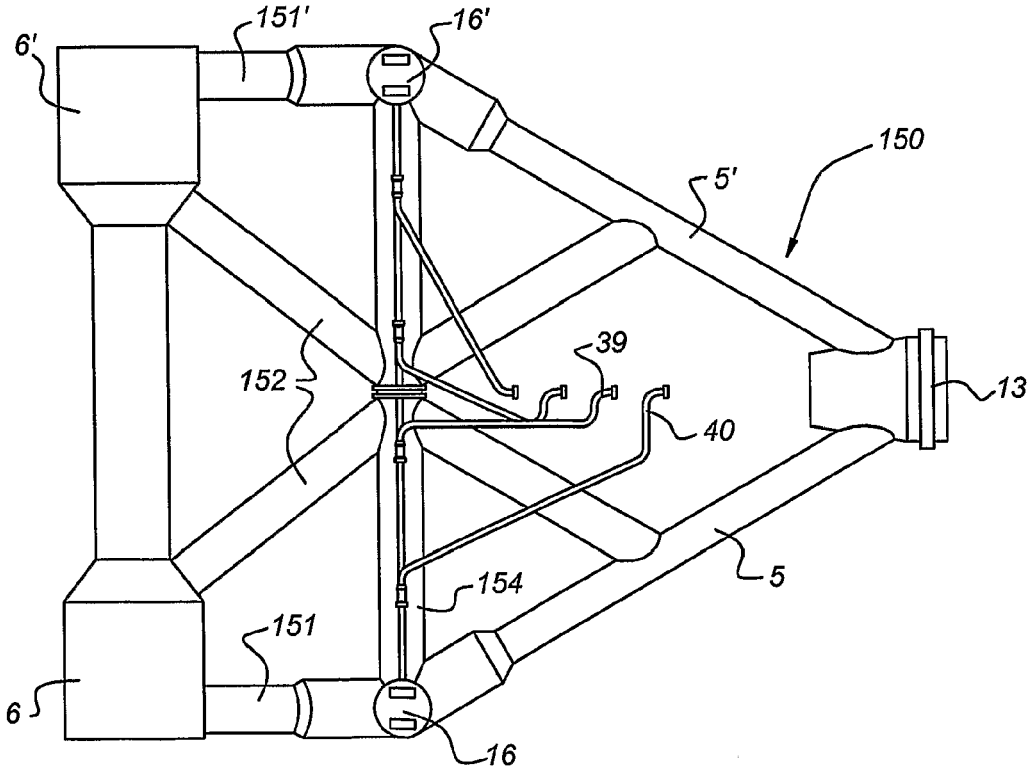
Figure 19:
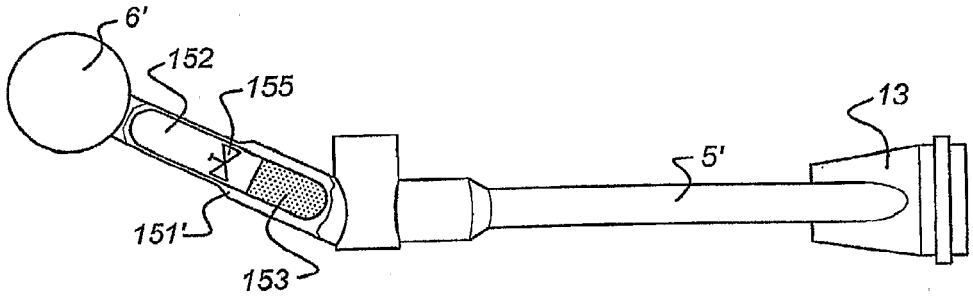
Figure 20:
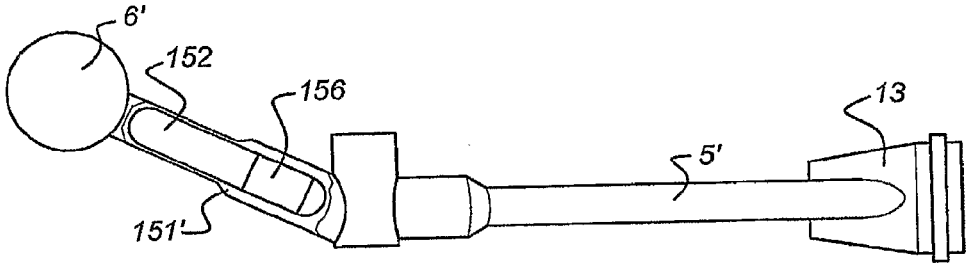
Figure 21:
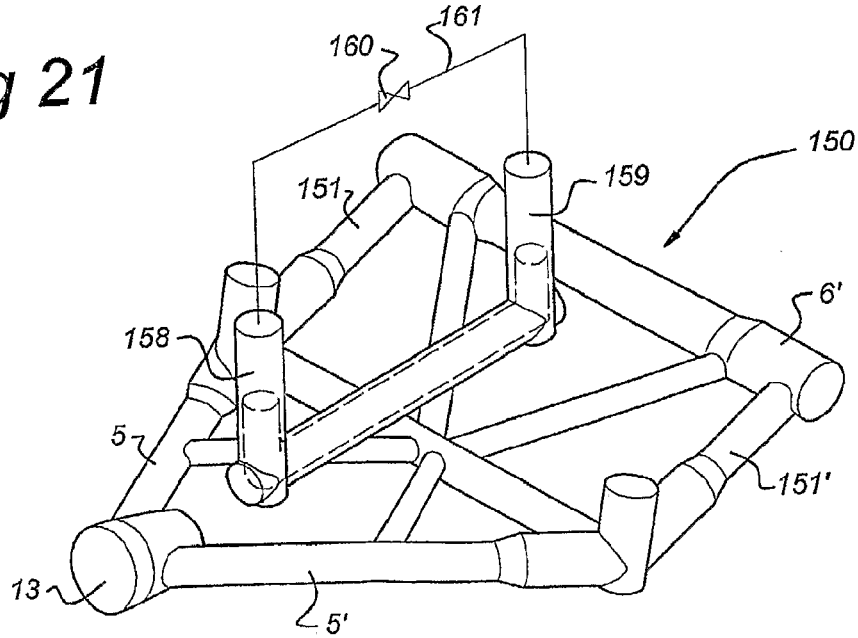
Figure 22:
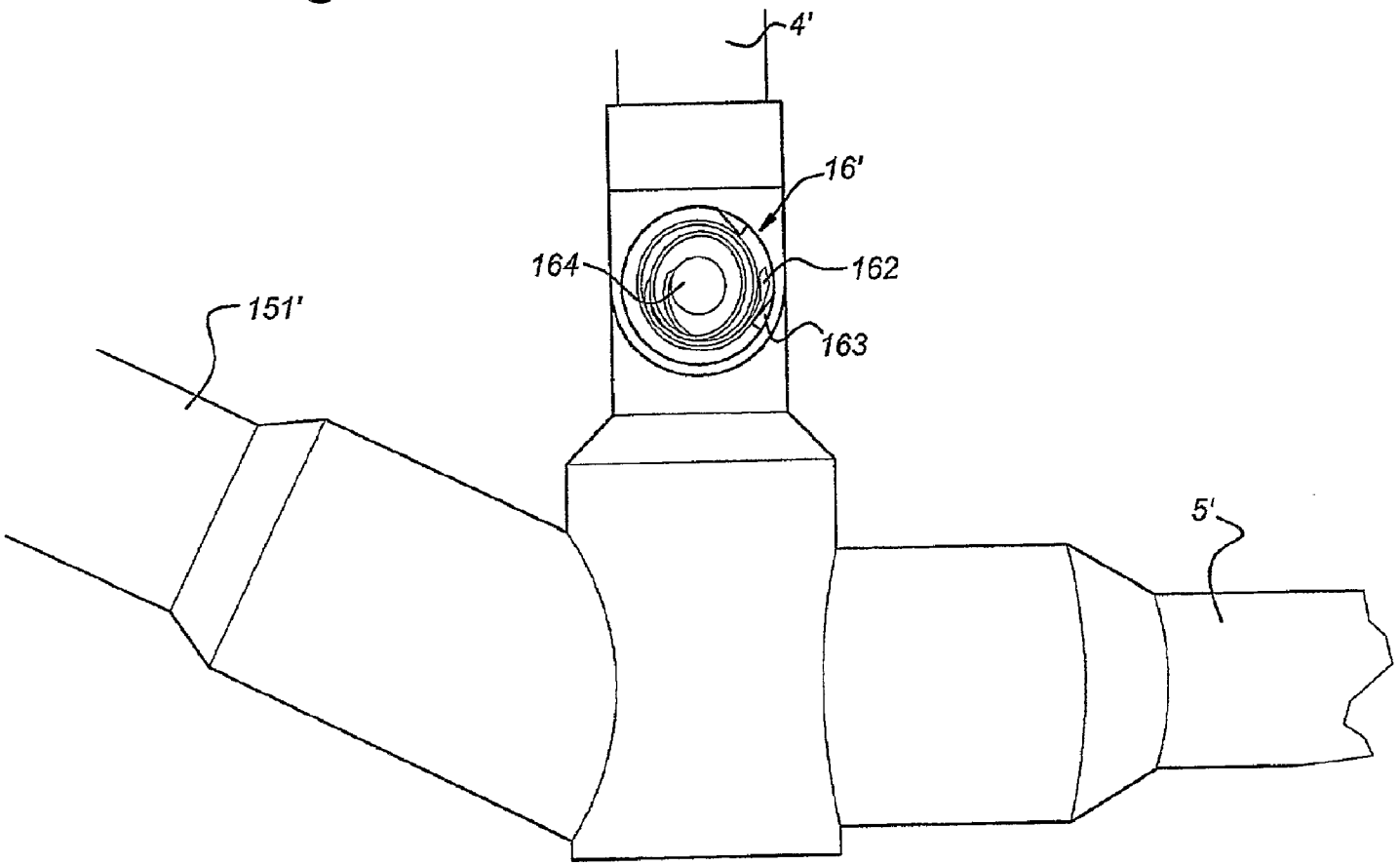
Figure 23:
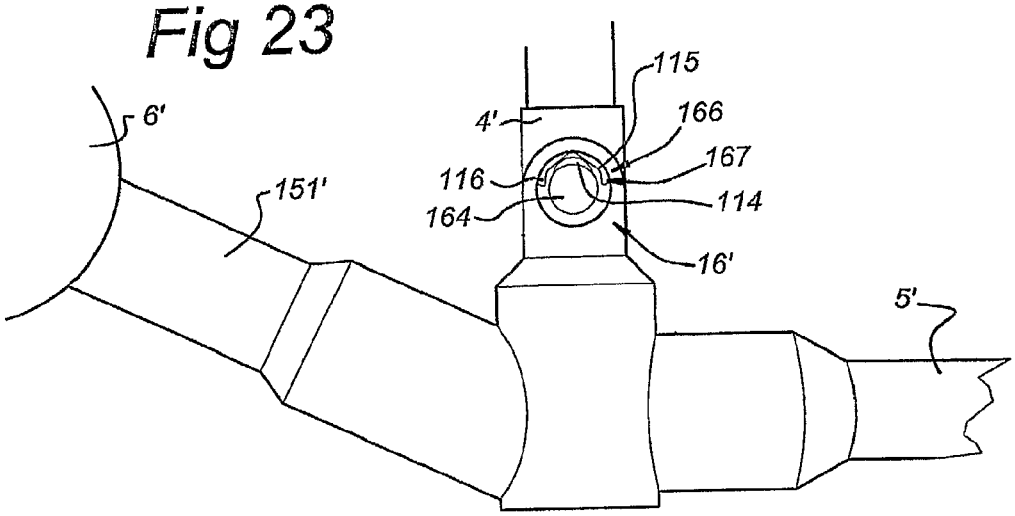

FIG. 17 shows an enlarged detail of the connected interfaces of the fluid ducts in the first and second connectors;

FIG. 18 shows a top view of an A-type frame according to the present invention;

FIG. 19 shows a damping system comprising a moving liquid mass;

FIG. 20 shows a damping system comprising a moving solid mass;

FIG. 21 shows a damping system comprising communicating U-tubes;

FIG. 22 shows a damping system comprising a spring mechanism;

FIG. 23 shows a friction damping system; and

Figure 24:
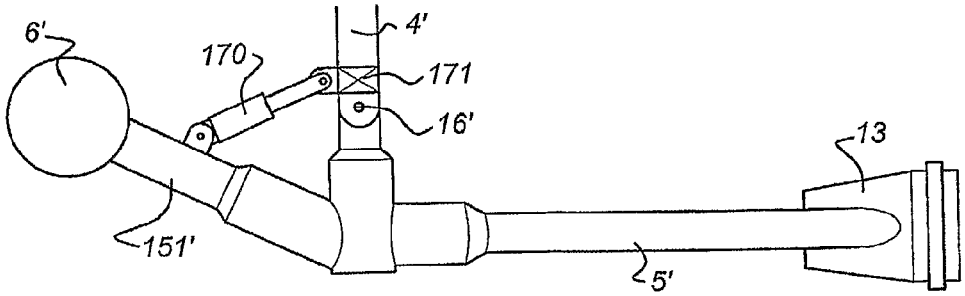

FIG. 24 shows a hydraulic damping system.

Figure 1:
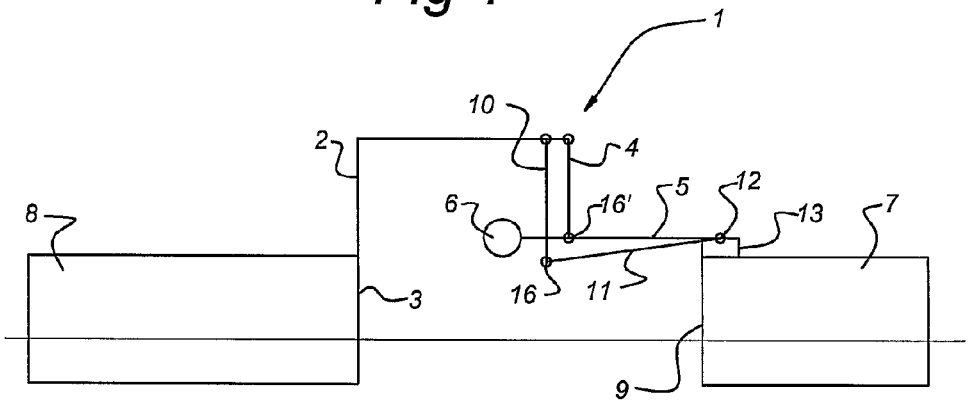
FIG. 1 shows a schematic side view of the cryogenic transfer system for tandem offloading according to the present invention.

FIG. 1 schematically shows the hydrocarbon transfer system 1 of the present invention comprising a support structure 2 placed at the stem 3 of a FPSO barge. From the support structure 2, a first vertical arm 4 is suspended and is connected to a substantially horizontal second arm 5. At a restoring end, a counterweight 6 is connected to the arm 5, which at a coupling end is provided with a mechanical connector 13 for attaching to the bow 9 the LNG-carrier 7. Parallel to the mooring arms 4, 5 cryogenic fluid transfer lines 10, 11 are placed, which are suspended on one side from the support structure 2 and which on the other side are connected in an articulation joint 12 to the mechanical connector 13 of the mooring arm 5. By connecting the flow lines to the mechanical connector, a rapid connection is possible and also a rapid release during emergency situations. However, the transfer line 11 may at its end be connected to the arm 5 instead of to the mechanical connector. The end of transfer line 11 is provided with a fluid connector for connecting to the pipe system of the LNG-carrier 7 after mechanical connection. The dimensions indicated in FIG. 1 are indicative for the order of magnitude of the mooring and transfer system of the present invention by way of illustrative example.

Figure 2:
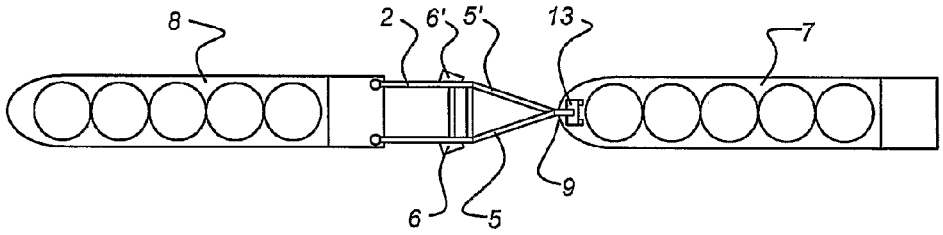
FIG. 2 shows a top view of the transfer system of FIG. 1.
Figure 3:
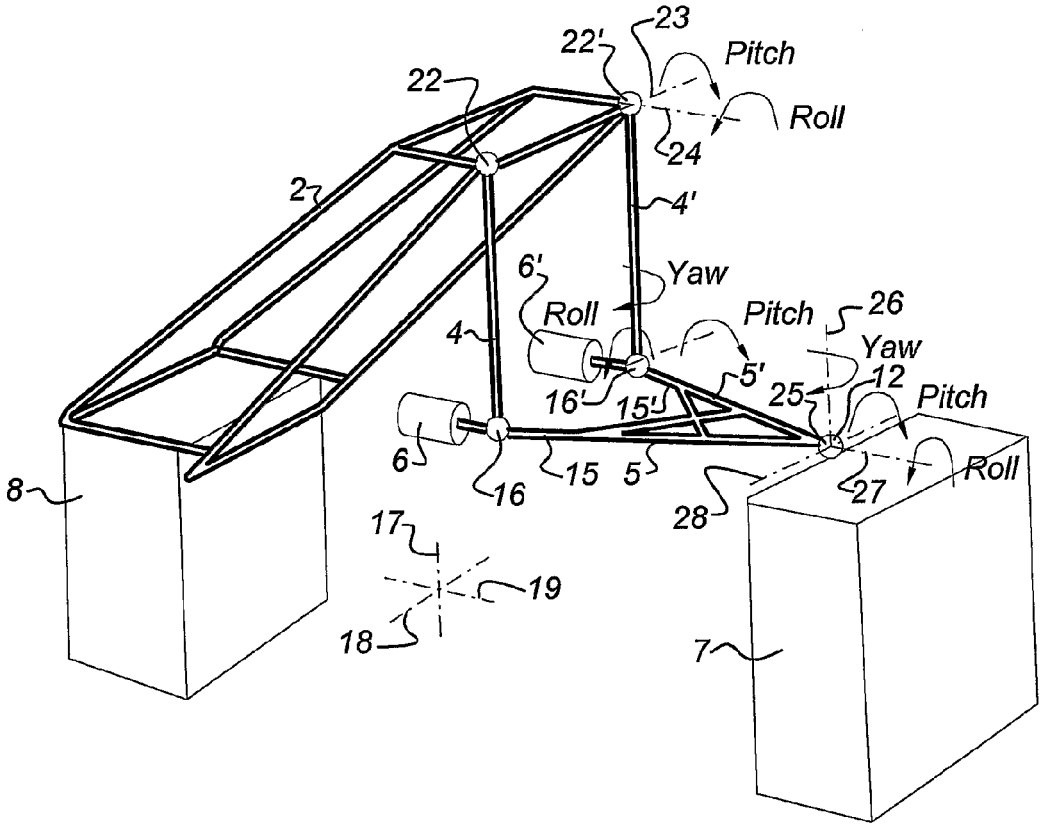
FIG. 3 shows a schematic perspective view of the mooring construction of the present invention.

FIG. 2 shows a top view of the FPSO 8 and LNG-carrier 7, the support structure 2, the horizontal mooring arms 5, 5' and the mechanical connector 13. As can be seen from FIG. 3, the horizontal mooring arms 5, 5' are with their restoring end parts 15, 15' connected to a respective vertical arm 4, 4' via articulation joints 16, 16'. Two counterweights 6, 6' are connected to the restoring end parts 15, 15' of each arm 5, 5'. The articulation joints 16, 16' may for instance comprise three perpendicular circular bearings, or ball-joints allowing rotation around a vertical axis 17 (yaw), a transverse axis 18 (pitch) and a longitudinal axis 19 (roll).

The vertical mooring arms 4, 4' are at their upper ends connected to the support structure 2 in articulation joints 22, 22' allowing rotation of the arms 4, 4' around a transverse axis 23 and a longitudinal axis 24. At the coupling end part 25, the arms 5, 5' are provided with the mechanical connector 13 allowing rotation around a vertical axis 26 (yaw), a longitudinal axis 27 (roll) and a transverse axis 28 (pitch). The mechanical connector is not shown in detail but may be formed by a construction such as described in U.S. Pat. No. 4,876,978 in the name of the applicant, which is incorporated herein by reference.

Figure 4:
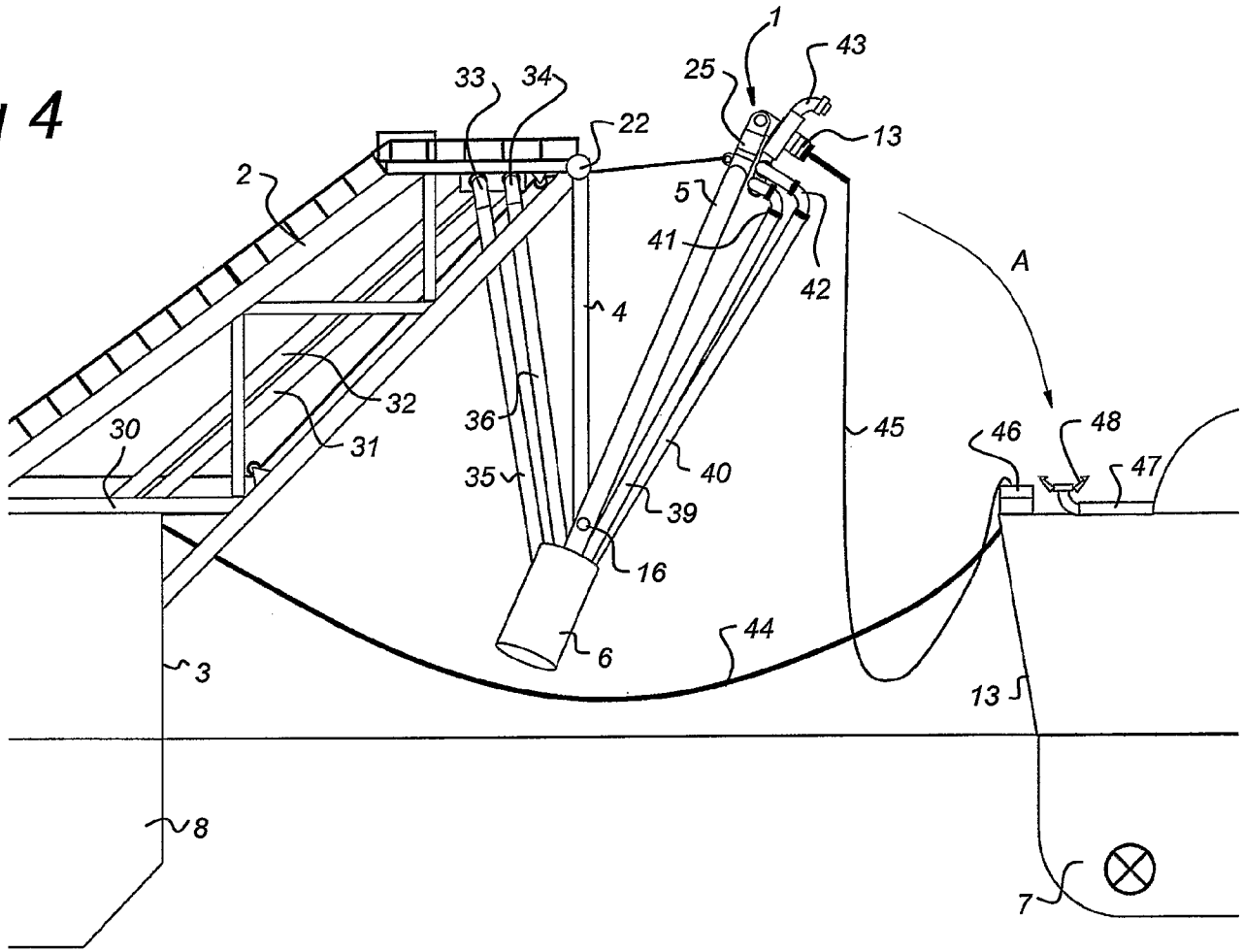
FIG. 4 shows a side view of the mooring arms and transfer pipes prior to coupling of the mechanical and fluid connectors.

FIG. 4 shows the transfer system 1 in which the mooring arms 5 are placed in a substantially vertical position via a cable 30 attached to the coupling end part 25 of the arms 5, 5' and connected with its other end to a winch (not shown) on the FPSO 8. Two rigid pipes 31, 32 extend from the FPSO 8 to a swivel connection 33, 34 on the support structure 2. From the swivel connections 33, 34 two vertical pipes 35, 36 extend downwardly to swivel connections 37, 38 (see FIG. 5). Two horizontal cryogenic transfer pipes 39, 40 extend along the arms 5, 5' to swivel connections 41, 42 on the mechanical connector 13. A fluid connector 43 is provided on the mechanical connector 13.

During connecting of the mooring arms 5, 5' to the bow 9 of the LNG-carrier 7, the vessels are connected via a hawser 44. Via a pilot line 45, the mechanical connector 13 can be lowered and placed into a receiving element 46 on deck of the LNG-carrier 7. By paying out cable 30, the horizontal arm 5 pivots in articulation joints 16, 16' around the transverse axis 18. The vertical ducts 35, 36 can pivot around a transverse axis 23 in articulation joints 33, 34 and in articulation joints 37, 38 as shown in FIG. 5 to assume a substantially vertical position.

Figure 5:
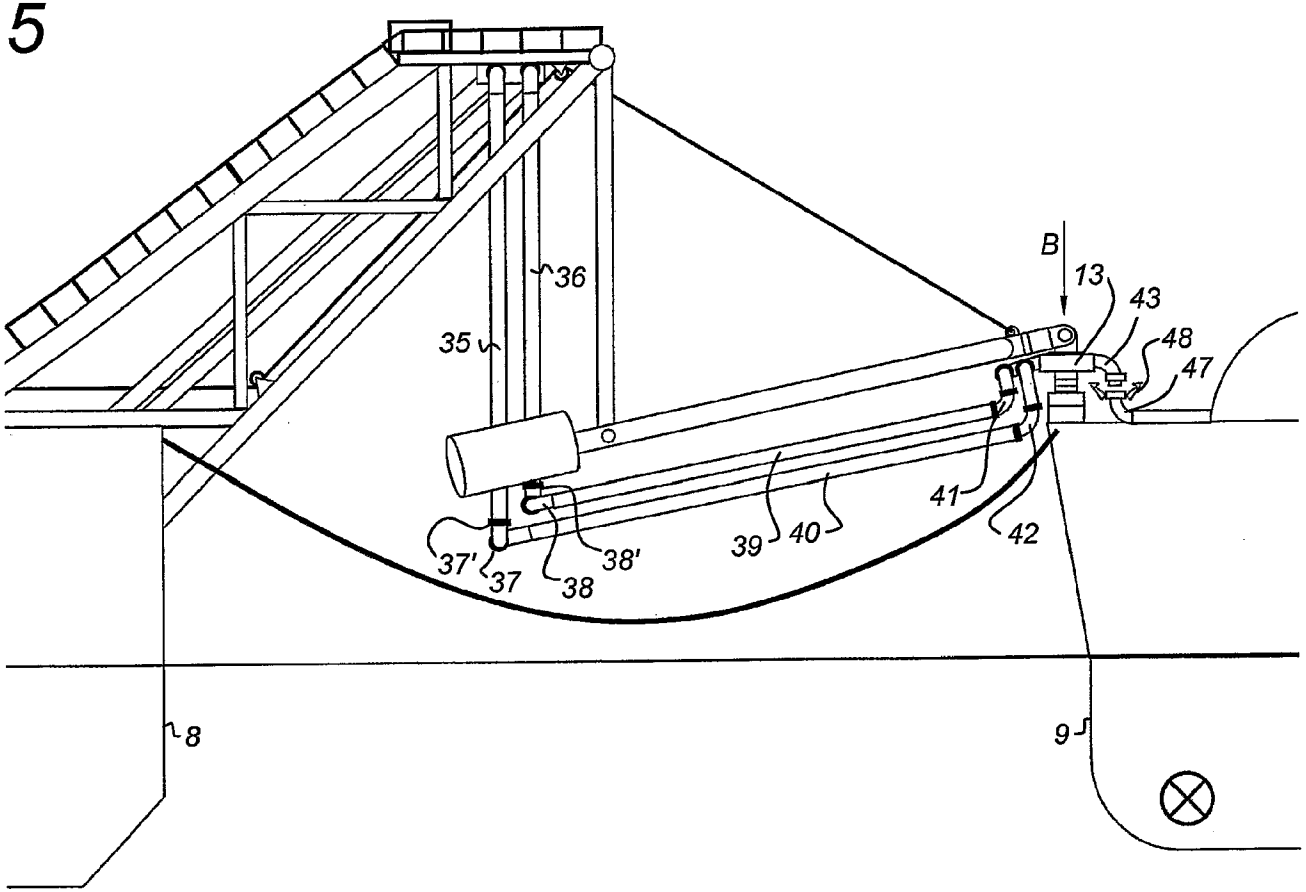
FIG. 5 shows the transfer system of FIG. 4 wherein the mooring arms are attached via the mechanical connector.
Figure 6:
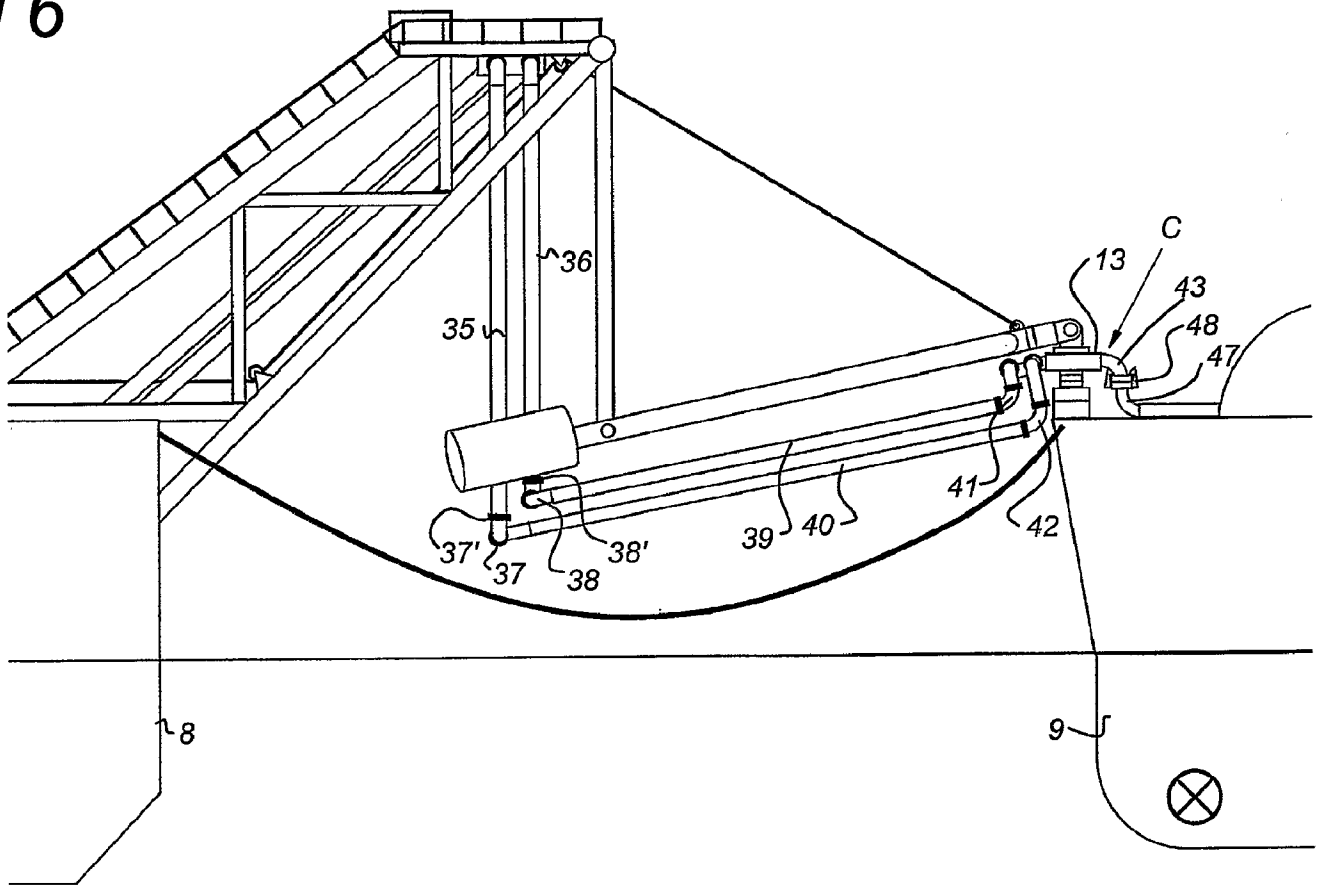
FIG. 6 shows attachment of the fluid connector of the transfer lines.

The horizontal ducts 39, 40 will also pivot around a vertical axis at swivels 37', 38' and a transverse axis a horizontal axis and a vertical arm at the position of two sets of each three perpendicular swivels 41, 42 until the mechanical connector 13 mates with receiving element 46 as shown in FIG. 5. After locking the mechanical connector 13, the fluid connector 43 is attached to piping 47 on deck of the LNG-carrier 7 by raising said piping and engaging clamps 48 such as shown in FIG. 6.

Figure 7:
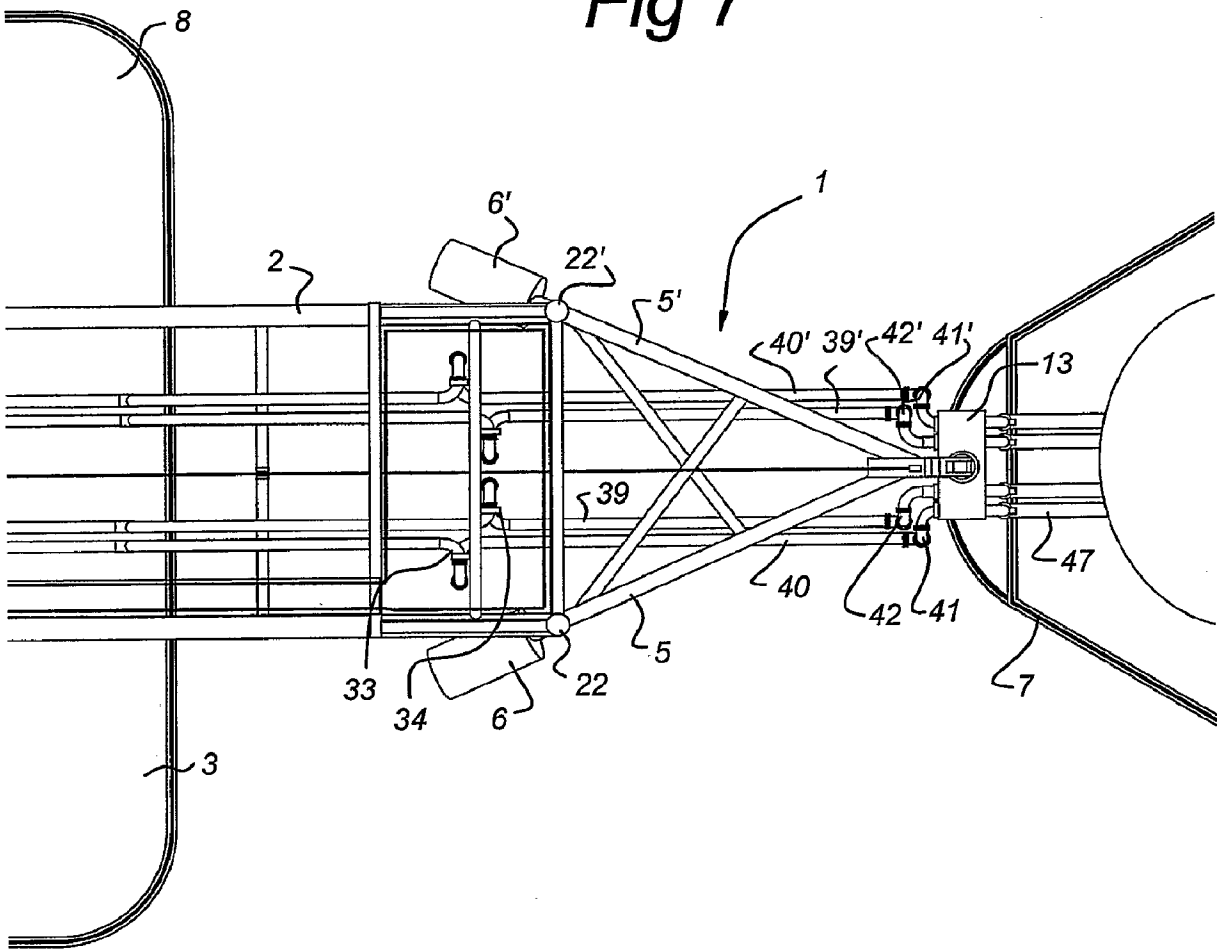
FIG. 7 shows a top view of the transfer system of FIG. 4-6.

FIG. 7 shows a top view of the transfer system 1 in the connected state showing four pipes 39, 39', 40, 40' attached to the mechanical connector 13. The transfer pipes 35, 36 are connected to the support structure 2 in articulation joints 33, 34 and can pivot around a substantially longitudinal axis. The pipes 39, 39', 40, 40' are connected to the mechanical connector 13 in articulation joints 41, 41', 42, 42' and can pivot around a longitudinal, a transverse and a vertical axis. The pipes can move independently of the mooring arms 4, 4', 5, 5'. During yaw-movements of the FPSO 8 or LNG-carrier 7, a good control and sufficient yaw-stiffness is achieved by the arms 5, 5' connected to the counterweights 6, 6'. Yaw displacement (in the horizontal plane) of the LNG-carrier will be counteracted by a restoring moment created by the counterweights 6, 6'. By separating the mooring function and the fluid transfer function, a simplified and proven cryogenic transfer system can be achieved using state of the art components and resulting in reduced and simplified maintenance.

Figure 8:
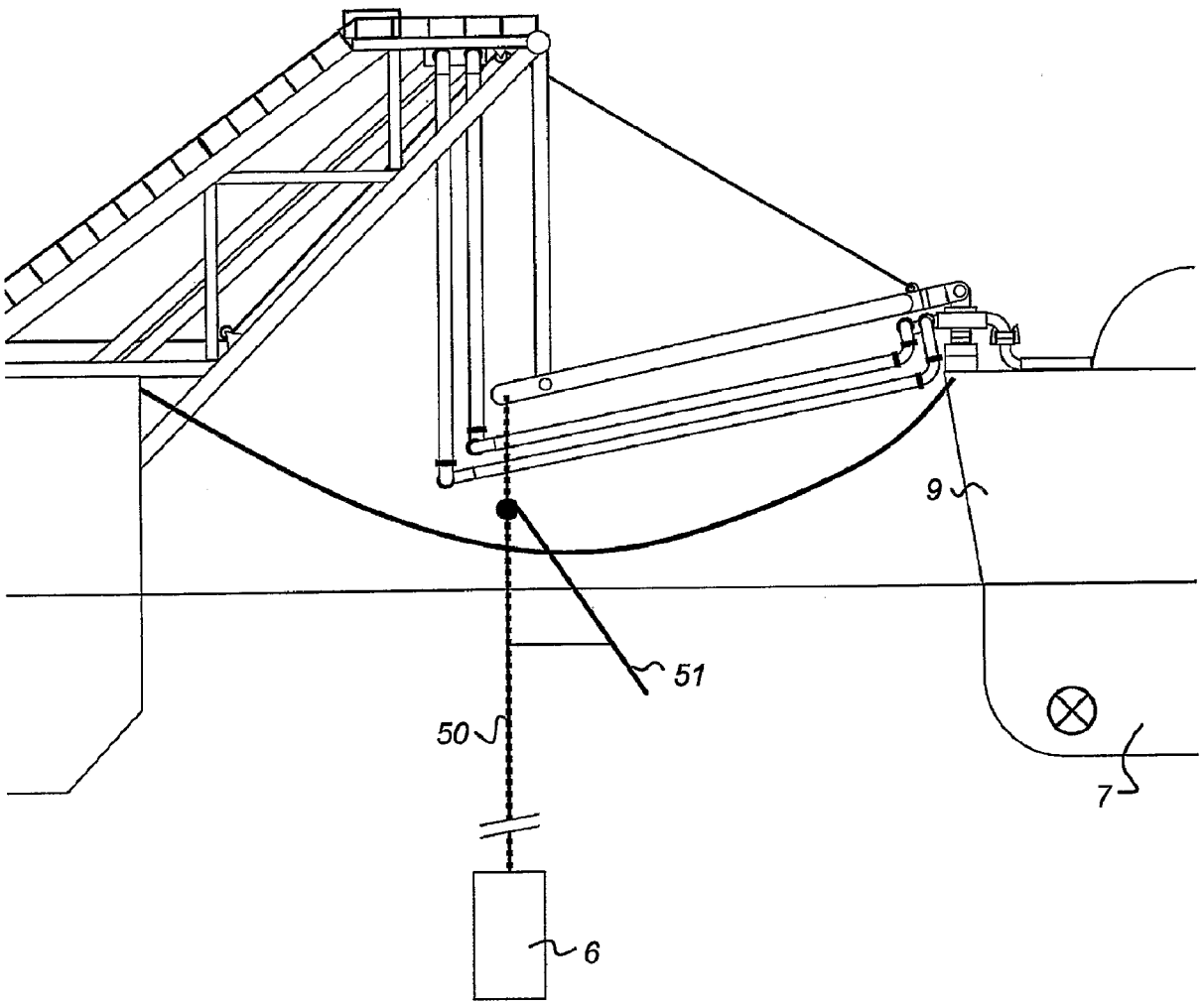
FIG. 8 shows an alternative embodiment of the counterweight of the mooring arms.

As shown in FIG. 8, the counterweights 6 may be suspended from a cable 50 such that movements of the counterweights 6 are damped below water level. A fender 51 may be applied on cable 50 for the counteracting movement of the vessel 7 towards vessel 8 upon lifting of the mooring system 1 to the configuration as shown in FIG. 4. When the bow 9 of the vessel 7 contacts the fender 51, the tension in the chain 50 will exert a restoring force on the vessel.

The fender system described above could be a fender system as described in U.S. Pat. No. 4,817,552 in the name of the applicant. The counterweights 6, 6' can be formed by clump weights, flushable tanks, buoyancy elements and other constructions generally employed in soft yoke mooring systems. Even though the invention has been described in relation to hard piping 35, 35', 36, 36', 39, 39' and 40, 40' in combination with pipe swivels at articulation joints 33, 34, 41, 42, also flexible hoses or combinations of flexible hoses and hard piping, and ball-joints instead of pipe swivels can be employed. An example of a ball-joint suitable for cryogenic fluid transfer has been described in WO00/39496, which is incorporated herein by reference.

Figure 9:
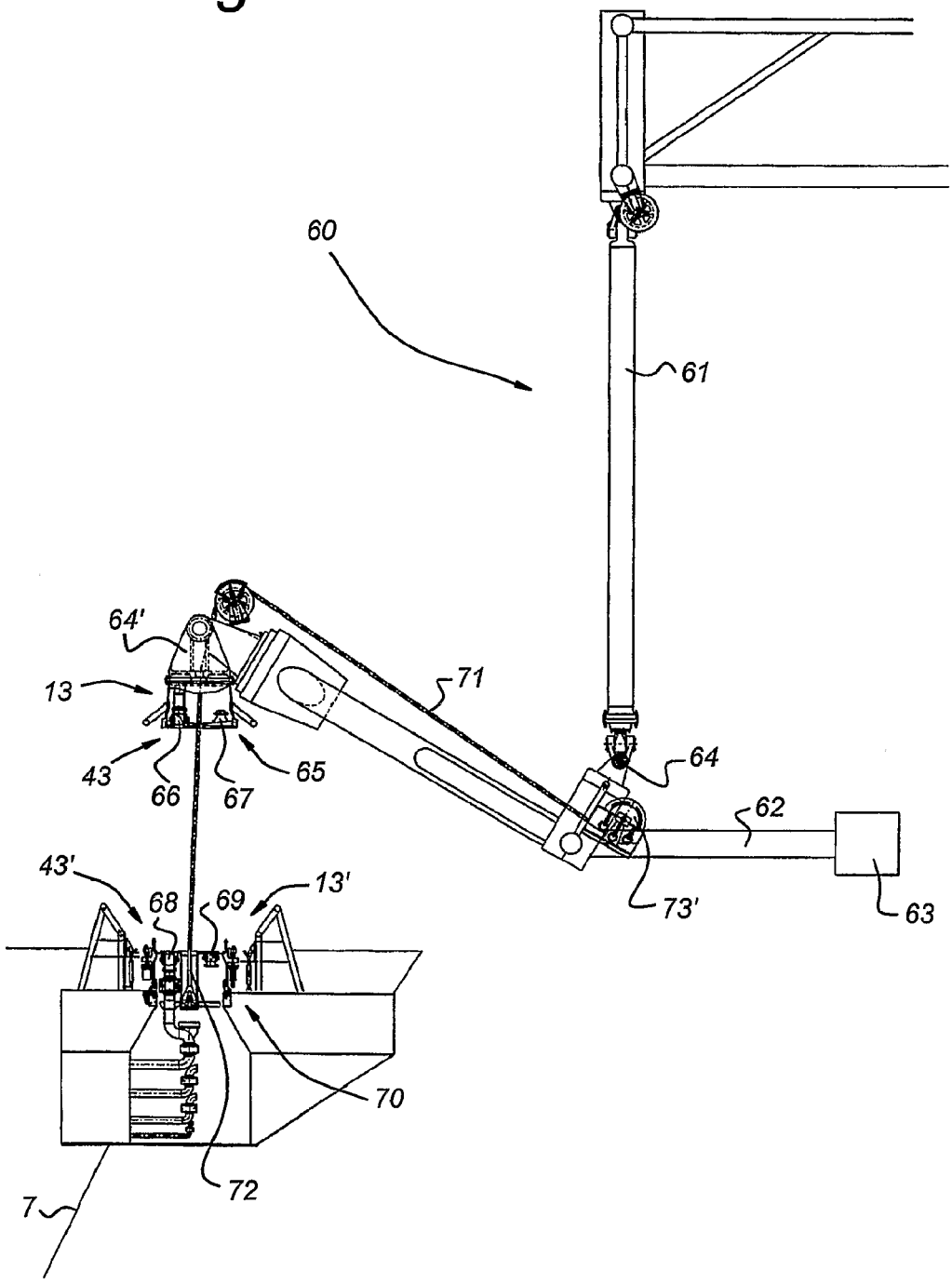
FIG. 9 shows a detail of the connector parts of a transfer system according to the present invention in the disconnected stage.

FIG. 9 shows the connectors of a hydrocarbon transfer system 60 according to the present invention, an articulated arm 61, 62. The structure can be a platform, a semi submersible structure, an offshore tower or arm or an onshore loading/offloading terminal. The arm 62 is supported in a substantially horizontal position in a hinge point 64 from vertical arm 61 and is balanced by a counterweight 63. At the free end 64', the arm 62 carries a first connector part 65 of mechanical connector 13, 13'. Within the arms 61, 62, or supported externally on the arms 61, 62, such as shown in FIGS. 4-8, hydrocarbon fluid ducts 66, 67, for instance LNG ducts and vapour return ducts, are situated. The ducts 66, 67 can be attached to fluid transfer ducts 68, 69 in second connector part 70 of fluid connector 43, 43'. The first connector part 65 can be lowered onto the second connector part 70 on the vessel 7 via a cable 71 which extends through a central space 72' of connector part 70 and through the connector part 65 at the end of arm 62, to a winch 73' on the arm 62.

Figure 10:
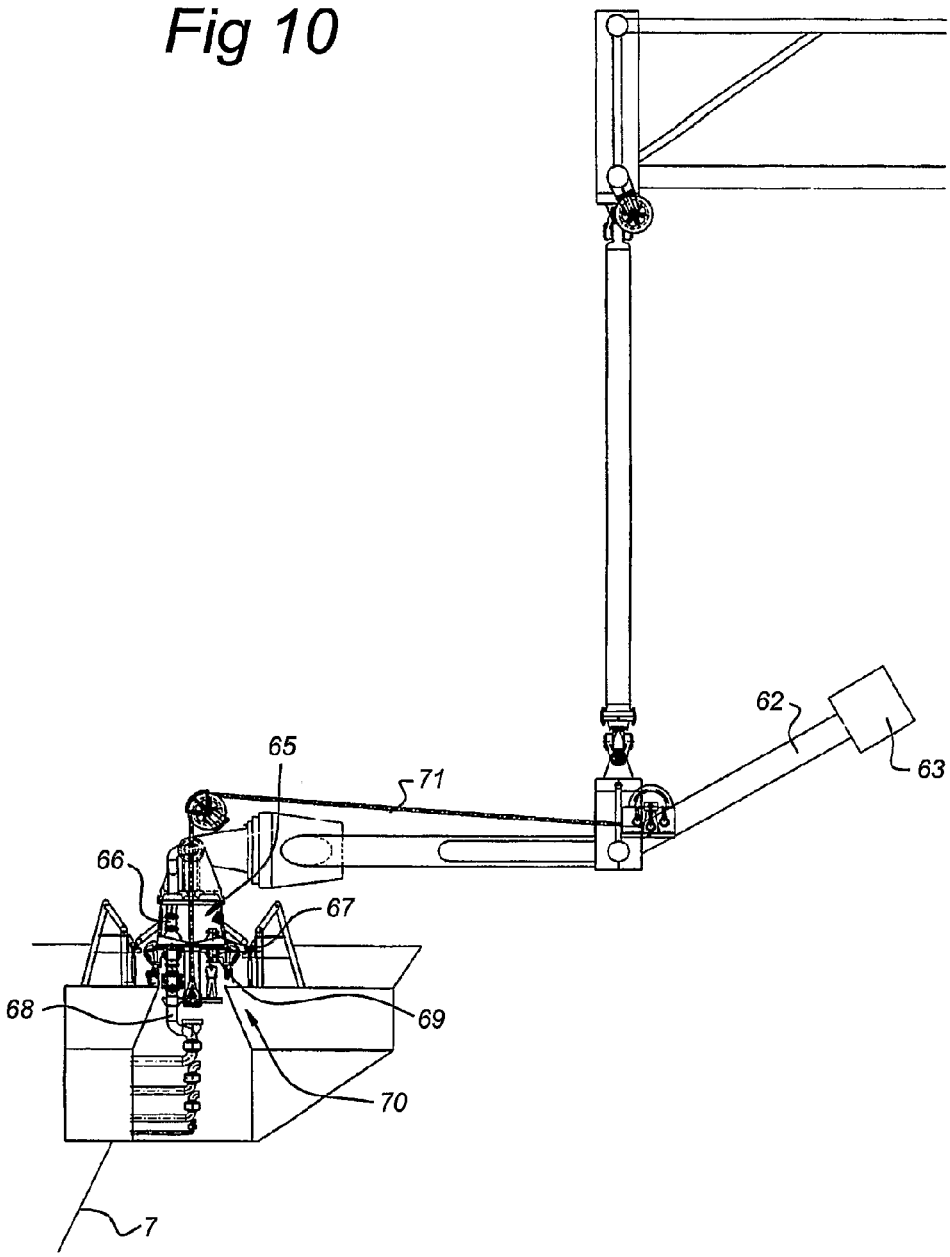
FIG. 10 shows the connector parts of FIG. 9 in the connected situation.

As can be seen from FIG. 10, by tightening the cable 71, the first connector part 65 and second connector part 70 can be engaged and locked in position, and fluid connection between fluid transfer ducts 66, 68, 67, 69 is established.

Figure 11:
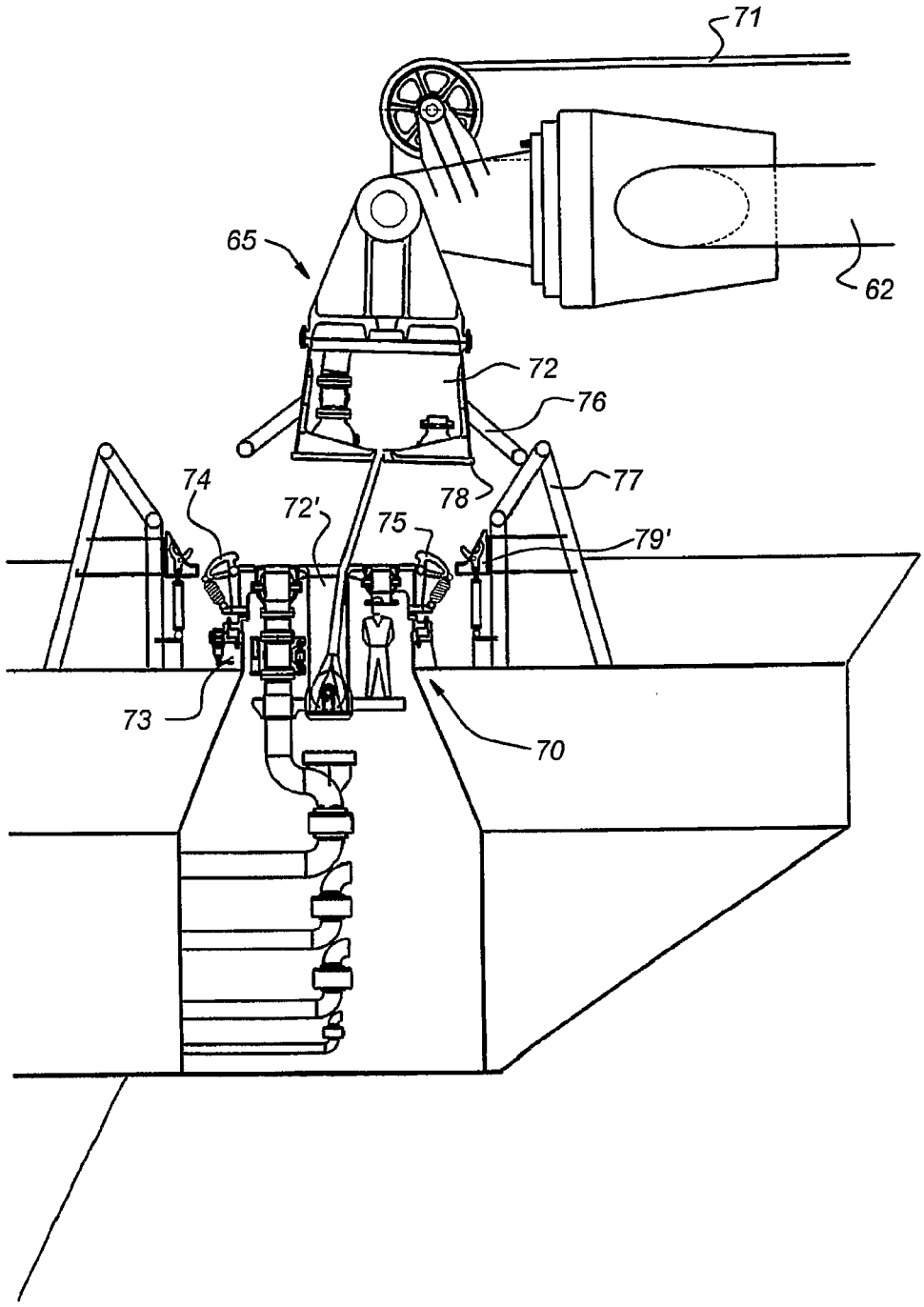
FIG. 11 shows a detail of the connector parts of FIG. 9, the connector parts at the end of the arm approaching the connector parts on the vessel.

In FIG. 11 it is shown how the housing 72 of first connector part 65 is provided with a sideways flange or fender 76 for positioning of the first connector part 65 with respect to a fender 77 placed around and above second connector part 70. By lowering the arm 62, the connector part 65 is guided by the downwardly sloping part of the fender 77 to the second connector part 70 by tightening of the cable 71, to an approximate coupling projection.

Figure 12:
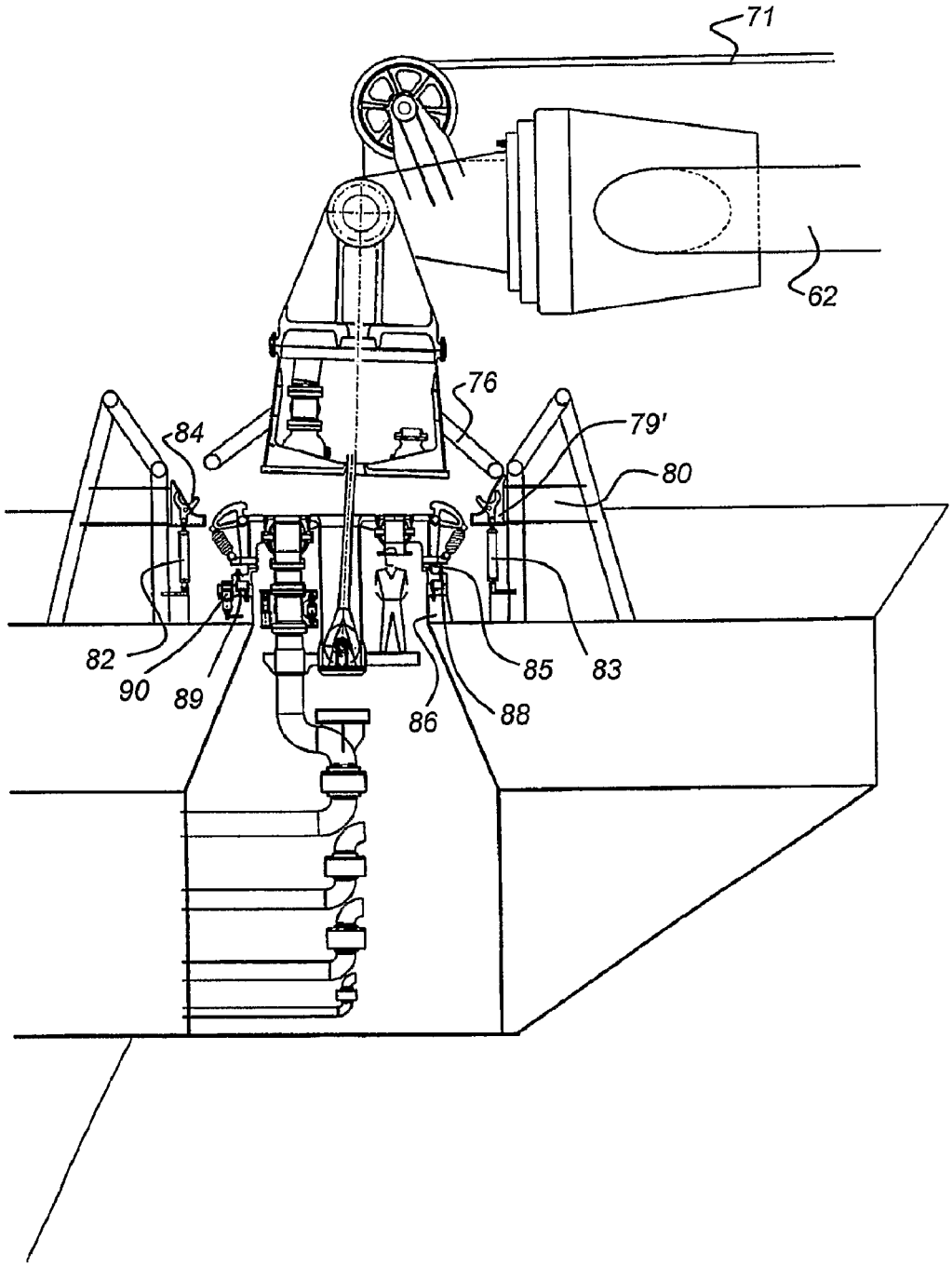
FIG. 12 shows the connector parts prior to engagement of retractable grippers.

As is shown in FIG. 12, the fender 76 is contacted by a guiding surface 79, which is mounted on a frame 80. By sliding down the guiding surface 79', the fender 76 can be engaged with hydraulic grippers 82, 83, as shown in FIG. 13. The grippers 82, 83 comprise a hydraulic cylinder and rotatable clamping head 84 that, when placed in the position shown in FIG. 13, clampingly engages with fender 76.

As shown in FIG. 14, the housing 72 of first connector part 65 and housing 73 of second connector part 70 are placed one on top of the other, in an aligned position, whereafter the grippers 82, 83 are released and the locking member 74, 75 are engaged with circumferential rim 78 on housing 72. Prior to or after attaching the locking member 74, 75, in the situation shown in FIG. 13, the upper part 85 of housing 73 of second connector part 70 can be rotated around a centreline relative to a support part 86 via bearings 88, 89. Rotation is imparted by a drive motor 90, which may rotate the upper part 85 through a small angle or through 360° when required. Rotational sections of the ducts interconnected via first and second connector parts 65, 70 are placed within the vessel 7 below second connector part 70 as shown in FIGS. 11, 12 and 13 for swivels 91, 92 and 93.

As can be seen in FIG. 15, the housing 72 of upper connector part 65 is attached to housing 73 of second connector part 70 through a collet ring 79 locking on the circumferential rim 78 on housings 72, 73. After mechanical interconnection of housings 72, 73, or simultaneous therewith, the sealing faces 94, 95 of fluid ducts 66-69 are engaged. The ducts 68, 69 in the lower connector part 70 each comprise displacement members 97 in the form of a deformable bellow wall part 98, a hydraulic jack 99 and a spring 100. During the connection phase, the bellows 98 are retracted by the hydraulic jack 99 attached adjacent to the bellow by a few mm to a few cm below the plane of interconnection of housings 72, 73. Retraction of the hydraulic jack 99 compresses spring 100 such that the sealing face 94 is retracted below the contacting surface of lower connector part 73. After connection of the collet ring 79, by actuation of hydraulic jacks 101, the jack 97 is depressurised such that spring 100 will push the upper part of fluid duct 68 upwards against the sealing face 94, 95 of upper fluid ducts 66, 67. After connection of fluid ducts 66, 68, both fluid duct sections 66, 68 will be able to rotate together upon rotation of rotating part 85 of lower connector part 73 on bearings 88, 89 and upon rotation of the upper duct section of duct 68 relative to stationary piping on the vessel 7 via swivel 91.

Each duct 66, 68 comprises ball valves 102, 103 which are closed prior to connecting duct sections 66, 68 and which are opened after fluid tight connection of the sealing faces 94, 95. The ball valves 102, 103 are situated near the end sections of the ducts, such that small gas volumes are present above the valves, such that safe disconnecting can take place without a risk of large volumes of gas being set free.

As shown in FIG. 16, four ducts 105, 106, 107, 108, such as product fluid line (LNG), a vapour return duct, a warning gas duct, displacement gas duct, and a back up duct, are comprised in a support frame 110. Ball valves 105-108 are each opened and closed by a respective valve actuating unit 112.

FIG. 17 shows the sealing face 94 of upper duct 66 and lower duct 68 comprising angular seals 113, 114 and a slide bearing 115, 116. The slide bearings 115, 116 have a dual function as they isolate the fluid path of ducts 66, 68 from the other parts of the connector and they function as slide bearings for allowing relative movement of the lower duct 68 with respect to supporting frame 110. The rings 115, 116 can for instance be made of PTFE.

FIG. 18 shows the A-shaped frame or soft yoke 150 of the present invention, wherein the cross beams extending between the counterweight 6,6' and transverse beam 154, form hollow channels 152 for containing a damping liquid, such as water. The channels 152 are inclined when the arms 5,5' are in their horizontal position, as can bee seen from FIG. 19. The channels 152 can be fitted with plates, perpendicular to their longitudinal axis of symmetry. The plates may be solid, and extend partly across the channel cross section, or may be perforated, such as to have an open area of for instance 30%. In the embodiment of FIG. 19, a flow control non-return valve 155 forms a flow restriction, which determines the damping effect of water being displaced along the channel 152.

When the A-frame 150 is disconnected from the vessel, it will pitch backwards towards the counterweight side. As the counterweight 6,6' is descending (for equilibrium), the liquid will be able to flow through the separation valve 155 into the rear side of the frames members, in the direction of the counterweight 6,6'. The system will now respond in a damped manner due to the opposing inertia created by the opposite flow (liquid is still flowing down as the frame responds and moves upwards) and the weight of the water. As the valve 155 is a non-return valve, the liquid will be prevented from returning to the now descending side (side of connector 13) of the frame, thereby generating an opposing force to the oscillation. At this stage, the oscillation (pitch motion) will slow down and stop. Since the liquid is now confined by the one-way valve 155 to the counterweight end, the arms 5,5' will come to rest in an upward position. If desired, the valve 155 can be designed to allow for liquid flow with a phase lag to the oscillation in order to generate a continuous dynamic damping effect.

In order to bring the arms 5, 5' back from their upward position to their horizontal, operative position, a simple, low capacity pump is sufficient in combination with a bypass system around the valve 155. Alternatively, the valve 155 can be designed to open or close for allowing liquid flow to return to the side of the channel 152 opposite the counterweight 6'.

The system as shown in FIGS. 18, and 19 is of simple design an has no moving parts, so it requires little maintenance.

In FIG. 20 a solid mass 156 is slidably received in channels in short arms 151,151' of the A-frame 150. A lubrication system is provided to introduce oil in the channel to improve sliding of the weight 156.

Advantages of the systems shown in FIGS. 18-20 are that in the operative position, a smaller restoring force on the vessel is exerted by the frame 150 when the weight 153,156 is close to the axis of rotation (pitch), such that the load on the connection point is reduced and fatigue life of the frame and the vessel at connection is increased. Furthermore, the system of FIGS. 18-20 allows a wide range of pitch control. Tailoring the viscosity of the fluid mass 152 or the speed of travel of the sliding weight 156 allows the system to be fine-tuned to suit the on site conditions. Also, the inclination of the short arms 151,151' or of the channels 152 can be adjusted to provide additional control of the dynamic characteristics of the frame 150.

FIG. 21 shows a U-tube damping construction, wherein a horizontal channel 157 is attached to two transverse channels 158, 159. The transverse channels 158, 159 are equipped with an air-flow control valve 160 in an interconnecting air duct 161 which controls air flow between the tubes 158, 159. When the A-frame 150 is disconnected from the vessel, the liquid will flow from the tube 158 to the lowered tube 159. When the counterweight 6,6' is ascending, the flow of liquid in the channels 157, 158 and 159 will generate a counteracting inertia which will dampen the oscillatory motion. The frequency of the motion of the liquid in the channels 157-159 can be determined by the cross section of the channels and by opening and closing of the air-flow control valve 160.

In the embodiment shown in FIG. 22, a circumferential spring 162 and a spring charging mechanism 163 are installed around the rotation pin 164 of articulations 16, 16'. The springs are tightened upon downward movement of the counterweight 6' and slow its motion at peak speed and to bring the oscillation to a prompt stop. Upon upward movement, the spring locking mechanism is released so that the springs do not generate a returning upward movement.

In the embodiment shown in FIG. 23, a cam profile 166 is provided on the pin 164 of the articulations 16,16' connecting the horizontal arms 5,5' to the vertical arms 4,4'. On the inside of the ring connector which carries the horizontal arms 5,5' (not shown in this figure), a profiled friction pad 170 is provided. The friction pads absorb the energy associated with the oscillation, and are designed to generate increasing friction at the end of the stroke of the oscillation, and have low resistance in the horizontal mooring position of the arms 5,5'. The damping system is light weight and only requires a small modification of the system.

Finally, FIG. 24 shows a damping system using a hydraulic cylinder 170 attached between the vertical arm 4' and short arm 151'. The cylinder 170 is attached via a slide bearing to allow free yaw motion. The piston of the cylinder 170 is designed in such a way that it does not apply any force in the mooring configuration such as shown in FIG. 23, but only applies a force after disconnecting of the vessel from connector 13.

The invention claimed is:

1. Hydrocarbon transfer system comprising a first structure (8) having a substantially vertical first arm (4,61) hingingly connected to the first structure (8) via a first articulation (22,22') around a substantially horizontal axis (23) and a second arm (5,62) attached to the first arm in an articulation joint (16,16', 64), the second arm (5,62) having a connecting arm part carrying a releasable connector (13,65) for connecting to a floating second structure (7) and a restoring arm part carrying a counterweight (6,6') for exerting a restoring force on the second structure that is connected to the second arm upon relative movement of the first and second structures, characterized in that damping means are provided above water level, acting on the second arm (5,62) for damping movement of the second arm (5,62) around the articulation joint (16,16', 64) upon transition of the second arm (5,62) from an operative position to an inoperative position after disconnecting the releasable connector (13, 65) from the second structure (7), wherein the second, arm (5,62) in the operative position extends in a substantially horizontal direction, the second arm (5,62) in the inoperative position being rotated upward through an angle of at least 15 degrees in the articulation joint (16,16', 64), relative to the operative arm position and wherein hydrocarbon transfer ducts (35,36,39,40,66,67, 68,69) are provided in or on the first and second arms (4,5, 61,62), wherein the damping means comprise a damping member situated in the articulation joint (16,16',64) increasing the moment required for upward rotation of the second arm in the articulation joint.

2. Hydrocarbon transfer system according to claim 1, wherein the articulation joint comprises a pin (164) on one of the first or second arms and a rotating eye (167), rotatable around said pin on the other of the of the first or second arms, the damping member comprising a circumferential spring (162) in the articulation joint attached with one end to the pin (164) and with an other end to the eye (167).

3. Hydrocarbon transfer system according to claim 1, wherein the articulation joint comprises a pin (164) on one of the first or second arms and a rotating eye (167), rotatable around said pin on the other of the of the first or second arms, the damping member comprising a projection (166) on the pin (164), engaging with a complementary projection on the eye upon movement of the second arm to the retracted position, the projections not substantially engaging upon relative movement of the first and second arms in the operative position.

* * * * *

UNITED STATES PATENT AND TRADEMARK OFFICE

CERTIFICATE OF CORRECTION

PATENT NO. : 7,610,934 B2
APPLICATION NO. : 10/555791
DATED : November 3, 2009
INVENTOR(S) : Naciri et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 583 days.

Signed and Sealed this

Twelfth Day of October, 2010

David J. Kappos

David J. Kappos
*Director of the United States Patent and Trademark Office*